United States Patent [19]

Minami et al.

[11] 4,269,367

[45] May 26, 1981

[54] COIL WINDING MACHINE

[75] Inventors: Takehiro Minami; Hisashi Shigekusa, both of Yokkaichi, Japan

[73] Assignee: Tokyo Shibaura Denki Kabushiki Kaisha, Tokyo, Japan

[21] Appl. No.: 28,346

[22] Filed: Apr. 9, 1979

[30] Foreign Application Priority Data

Apr. 14, 1978 [JP] Japan ..... 53/44088

[51] Int. Cl.[3] ..... H01F 41/12; B65H 57/28

[52] U.S. Cl. ..... 242/7.08; 242/7.11; 242/158.2

[58] Field of Search ..... 242/7.08, 7.11, 7.15, 242/7.16, 7.22, 7.21, 56.1; 156/446, 447; 29/605, 25.42; 336/15

[56] References Cited

U.S. PATENT DOCUMENTS

| | | | |
|---|---|---|---|
| 2,011,463 | 8/1935 | Vianini | 242/7.22 |
| 2,422,307 | 6/1947 | Paluev | 354/344 |
| 3,106,504 | 10/1963 | Carter | 242/7.08 |
| 3,232,545 | 2/1966 | Ross et al. | 156/446 |
| 3,427,578 | 2/1969 | Gray et al. | 336/206 |
| 3,614,005 | 10/1971 | Chartier | 242/7.22 |

FOREIGN PATENT DOCUMENTS 1152756 3/1964 Fed. Rep. of Germany .

*Primary Examiner*—Billy S. Taylor

*Attorney, Agent, or Firm*—Stevens, Davis, Miller & Mosher

[57] ABSTRACT

In a coil winding machine for producing cylindrical coils each having a plurality of coil layers, an insulating bobbin is detachably mounted on a coil winding spindle driven by a driving source. A coil wire supplying device supplies a coil wire continuously onto the bobbin so as to form the coil layers, and an insulating tape supplying device continuously supplies an insulating tape over each coil layer so as to form tape windings partly overlapping each other in the longitudinal direction.

4 Claims, 8 Drawing Figures

COIL WINDING MACHINE

BACKGROUND OF THE INVENTION

This invention relates to a coil winding machine capable of winding cylindrical coils to be used in electric apparatus such as transformers, induction coils, reactors, and the like.

Heretofore, a cylindrical coil as shown in FIGS. 1(A) and 1(B) of the accompanying drawing has been produced by winding an electrically conductive wire (hereinafter termed coil wire) b around an electrically insulating frame (hereinafter termed bobbin) a of a cylindrical configuration, by a required number of coil layers, and, during the coil winding operation, a corresponding number of interlayer insulating sheets c are inserted between the respective coil layers, simultaneous with the application of coil end insulators $d_1$ and $d_2$ onto both ends of the coil layers.

However, the thicknesses of the coil end insulating materials $d_1$ and $d_2$ are substantially equal to the diameter of the coil wire b which is far thicker than the thickness of the interlayer insulating sheet c, and therefore two kinds of insulating materials have been prepared for the production of such coils. Where it is necessary to prepare various kinds of insulating materials and it is desired to reduce the number of types of insulating material for the simplification of stock control or the like, an interlayer insulating sheet e as shown in FIG. 2 having two lateral sides $e_1$ and $e_2$ folded into a W shape may be has been used instead of a simple sheet of an insulating material.

Regardless of the types of the interlayer insulating sheets c or e, however, when it is used between the coil layers the length of each interlayer insulating sheet c must first be estimated, and the sheets c must be cut beforehand into the estimated lengths in a separate sheet cutter. During the coil winding operation, the interlayer insulating sheets c thus cut into the estimated lengths are inserted successively between the coil layers, and the longitudinal ends of the successive sheets must be joined together in an overlapping relation by an adhesive agent or the like.

For performing these processes, many of the conventional coil winding machines incorporate a sheet cutter cutting the interlayer insulating sheets into the respective lengths, a sheet supplying device supplying the interlayer insulating sheets into the required positions, and a sheet bonding device which joins the longitudinal ends of the interlayer insulating sheets during the coil winding operation, thus complicating the construction, and rendering the maintenance and handling of the machine extremely troublesome. Furthermore, the alternate executions of the coil layer winding steps and the insulating sheet insertion steps have reduced the operating speed of the coil winding machine, caused mass-production of the coils to be extremely difficult.

SUMMARY OF THE INVENTION

An object of the present invention is to provide a coil winding machine wherein the above described difficulties associated with conventional coil winding machines can be substantially eliminated.

Another object of the invention is to provide a coil winding machine, wherein the coil winding operation and the layer insulating operation can be carried out simultaneously, and the productivity of the machine and its adaptability to mass-production can be substantially improved.

According to the present invention there is provided a coil winding machine comprising means for driving a coil winding spindle detachably supporting an insulating bobbin, means for supplying a coil wire continuously onto the bobbin so that the coil wire is repeatedly wound around the same, thus forming a required number of coil layers, and means for supplying an insulating tape continuously onto the coil winding part of the bobbin so that the insulating tape is wound around each coil layer in the form of tape windings partly overlapping each other in the longitudinal direction of the coil.

Preferably the means for supplying coil wire includes a wire guide movable along a feed screw extending in parallel with the axis of the bobbin and driven by the driving means of the coil winding spindle, and the means for supplying the insulating tape includes a tape guide movable along a feed screw extending in parallel with the axis of the bobbin and driven by a servomechanism operable depending on the position of the wire guide.

Preferably the servomechanism includes a function generaor in its circuit for controlling the movement of the tape guide in a nonlinear manner relative to the movement of the wire guide.

The invention will be better understood from the following detailed description of the invention with reference to the accompanying drawings.

DESCRIPTION OF THE PREFERRED EMBODIMENT

Figure 1A:
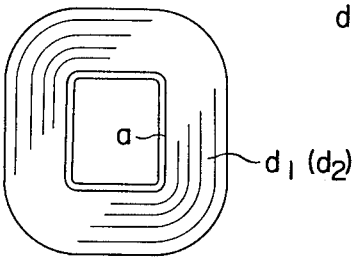
FIG. 1A PRIOR ART
FIGS. 1(A) and 1(B) are a plan view and a longitudinal sectional view, respectively, of a coil of a conventional construction.
Figure 1B:
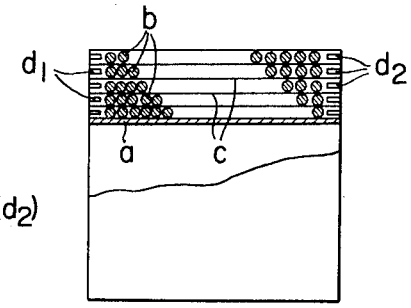
FIG. 1B PRIOR ART
Figure 2:
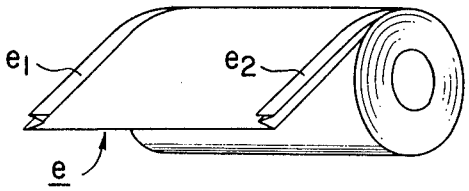
FIG. 2 PRIOR ART
FIG. 2 is a perspective view showing a conventional interlayer insulating sheet having lateral sides folded into W-shape.

The invention will now be described with reference to FIGS. 3 to 7. As shown in these drawings, a bobbin 2 made of an electrically insulating material and having a cylindrical shape is freely and detachably mounted on a coil winding spindle 1 driven by a driving device 3, for example an electric motor. Upon energization of the device 3, the coil winding spindle 1 is rotated together with the bobbin 2, thereby winding a coil wire 21 and an insulating tape 22 supplied as described hereinafter in detail around the bobbin 2. That is, in the proximity of the coil winding spindle 1, there are provided a wire feeding device 4 and a tape feeding device 5. The wire feeding device 4 comprises a feed screw 6 extending in parallel with the coil winding spindle 1, a wire guide 7 moved in engagement along the feed screw 6, a change gear 8 containing a reversible clutch secured to one end of the wire feed screw 6 to couple the same with the driving device 3, and a position detector 9 provided on the other end of the feed screw 6 for detecting the position of the wire guide 7.

The tape feeding device 5 comprises a tape feed screw 10 extending in parallel with the coil winding spindle, a tape guide 11 moved in engagement along the tape feed screw 10, a servomotor 12 provided at one end of the tape feed screw 10, and another position detector 13 provided at the other end of the tape feed screw 10 for detecting the position of the tape guide 11.

Near the tape feeding device 5, there is provided still another feed screw 14 extending in parallel with the aforementioned coil winding spindle 1. A wire reel 15 is moved in engagement along the feed screw 14, and another change gear 16 containing a reversible clutch is provided at one end of the feed screw 14. The change gear 16 is coupled with the machine driving device 3.

Figure 6:
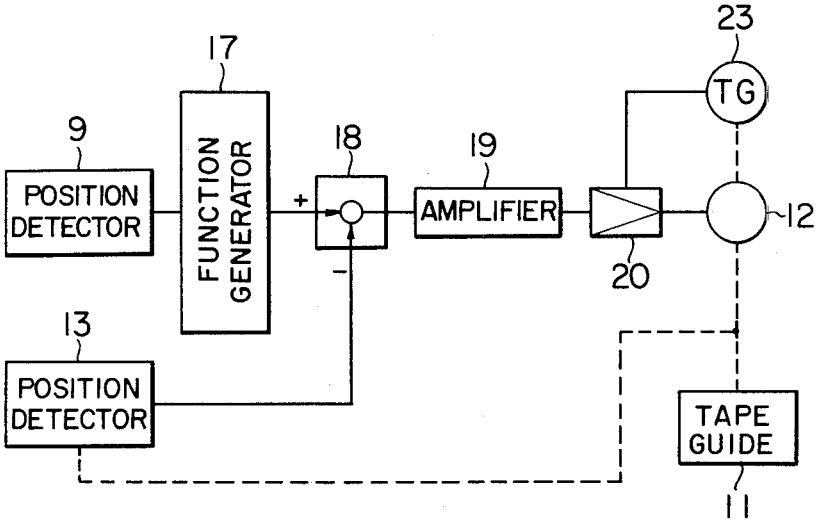
FIG. 6 is a connection diagram showing a servomotor control system used in the present invention.

The servomotor 12 driving the tape feeding device 5 is controlled as shown in FIG. 6 wherein an output signal generated by position detector 9 and passed through a function generator 17 is compared in a subtractor 18 with an output signal of the position detector 13. The difference is amplified by an amplifier 19 and is sent through a servo amplifier 20 to the servomotor 12. The rotation of the servomotor 12 is fed back through a tachometer generator 23 to the servo amplifier 20. The tape guide 11 is driven by the servomotor 12 in a manner as defined by the function generator 17 relative to the movement of the wire guide 7, and the position of the tape guide 11 is detected by the position detector 13.

Figure 4:
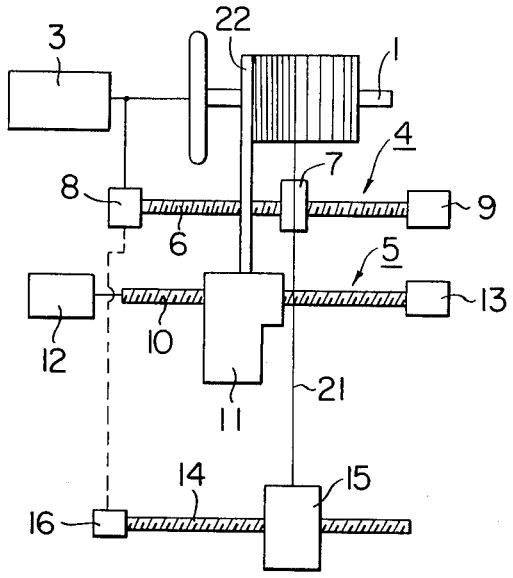
FIG. 4 is a plan view of the coil winding machine according to the present invention.
Figure 5:
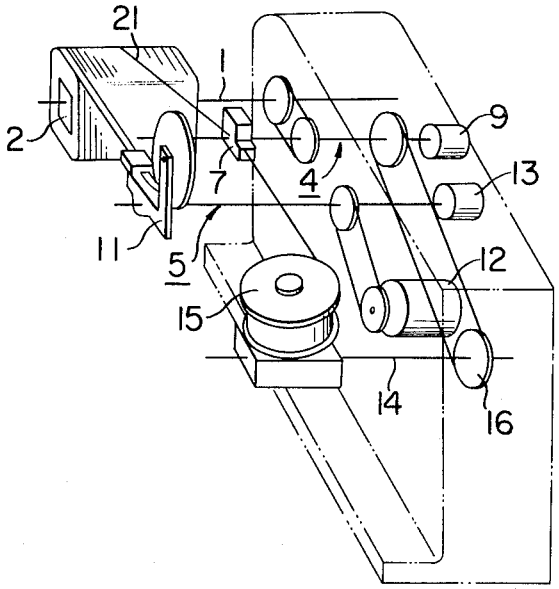
FIG. 5 is a perspective view of the coil winding machine shown in FIG. 4.

In the operation, the bobbin 2 is mounted on the coil winding spindle 1, and the leading end of the coil wire 21 supplied from the wire reel 15 through the wire guide 7 is fixed to a position at the leftward end of the bobbin 2 as viewed in FIGS. 4 and 5. The driving device 3 is then energized to rotate the coil winding spindle together with the bobbin 2, thereby winding the coil wire 21 around the bobbin 2 under the control of the wire guide 7 which is shifted rightwardly. When the position detector 9 detects the arrival of the wire guide 7 at a specific position along the length of the bobbin 2 as is hereinafter described in more detail, the coil winding operation is interrupted.

The leading end of an insulating tape 22 fed through the tape guide 11 is then manually fixed onto a suitable position near the leftmost end of the bobbin 2 where the coil winding operation has been initiated, and the driving device 3 is again energized with the simultaneous energization of the servomotor 12.

Figure 3A:
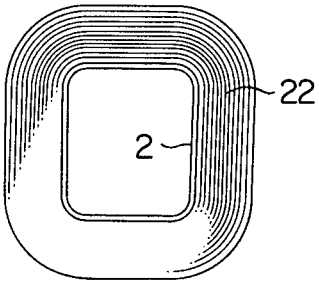
FIGS. 3(A) and 3(B) are a plan view and a longitudinal sectional view, respectively, of a coil produced by a coil winding machine according to the present invention.
Figure 3B:
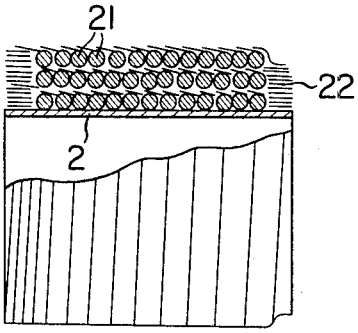

While the wire 21 is further wound around the bobbin 2 under the guide of the wire guide 7 rightwardly as viewed in FIGS. 4 and 5, the insulating tape 22 is first wound under the guide of the tape guide 11 which is kept at a standstill, around the leftmost end of the coil winding layer in a laminated manner so as to form a coil end insulation as shown in FIG. 3(B). Upon leftward movement of the tape guide 11, the tape 22 is wound over the coil layer in the form of tape windings partly overlapping each other in their widthwise direction (such as halflap windings), thereby forming an interlayer insulation.

The coil wire 21 and the insulating tape 22 arrive at the rightmost end almost at the same time. Upon arrival of the coil wire 21 at the rightmost end, the position detector 9 reverses the clutch contained in the change gear 8, and the coil wire 21 is thus guided by the wire guide 7 leftwardly, thereby forming a second coil layer over the previously wound insulating tape.

At this time, the tape guide 11 is held at a standstill under the action of the position detector 13, thus causing the insulating tape 22 to be wound around a position predetermined by the position detector 13 in the neighborhood of the right end in a laminated manner as shown in FIG. 3(B) while the wire guide 7 advances leftwardly thereby winding a second layer of the coil. The winding of the insulating tape around the predetermined end position is continued until a thickness of the lamination becomes equal to twice the thickness of the coil layer. The insulating tape 22 is thereafter, under the control of the tape guide 11, wound around the second layer of the coil in a partly overlapping manner along the widthwise direction, thereby forming a second interlayer insulation over the second coil layer.

In this case, it is assumed that the number of turns of the coil wire 21 required for forming one coil layer is equal to the number of turns of the insulating tape 22 required for forming one interlayer insulation inclusive of the coil end lamination, and that the coil wire 2 and the insulating tape 22 are therefore brought into the same coil end almost simultaneously.

Accordingly, a coil with a required number of coil layers and of the interlayer insulations as shown in FIGS. 3(A) and 3(B) can be obtained by simply repeating the above described operation for the required number of times.

Figure 7:
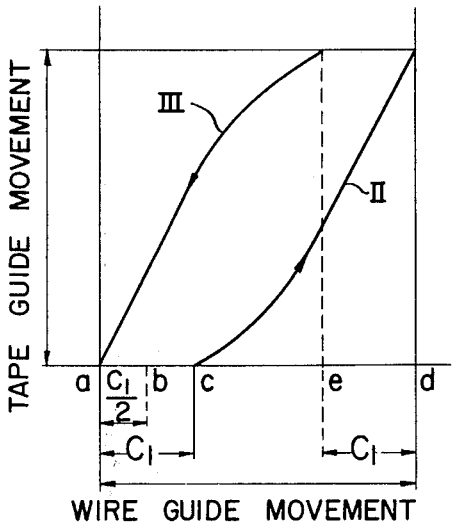
FIG. 7 is a diagram showing a relationship between a coil winding guide and an insulating tape winding guide in the coil winding machine of the present invention.

In a graphical representation shown in FIG. 7 wherein the movement of the wire guide 7 is represented by the abscissa and the movement of the tape guide 11 under the control of the servomotor 12 is represented by the ordinate. A curve II inclusive of a horizontal section ac ($=C_1$) represents a forward movement of the tape guide 11, and another curve III inclusive of a horizontal section equal to the length de ($=C_1$) represents a backward movement of the tape guide 11. At an instant when the wire guide 7 is moved for a first time from the leftmost end a to a position b ($ab=\frac{1}{2}C_1$), the position detector 9 interrupts the rotation of the coil winding spindle 1, and the leading end of the insulating tape 22 is fixed to the bobbin 2 at a predetermined position in the initiating stage of the coil winding operation. The coil winding spindle 1 is again rotated. Since the tape guide 11 is kept at a standstill until the wire guide 7 is moved to a position c, the insulating tape 22 is wound in a laminated manner over the predetermined position near the leftmost end for a number of turns corresponding to the length $C_1/2$ of the coil, thereby forming one part of the coil end insulation.

When the wire guide 7 is moved beyond the position c toward the end d at the right side of the coil, the tape guide 11 is moved away from the initiating end a of the coil winding operation toward the right end d along the curve II, thereby forming a layer insulation as described hereinbefore. It should be noted that the wire guide 7 and the tape guide 11 arrive at the rightmost end d almost simultaneously.

In the return pass of the wire guide 7, while the wire guide 7 is moved from the rightmost end d to a position e, the tape guide 11 is kept at a standstill, thereby forming a lamination of the insulating tape 22 of a number of turns corresponding to the length $C_1$ of the coil, thus providing a coil end insulation of a thickness corresponding to twice the thickness of one coil layer.

While the wire guide 7 is further shifted from the position e to the initial position a of the coil thereby forming the second coil layer, the tape guide 11 is shifted from the right end d to the initial position a of the coil thereby forming the second interlayer insulation. The tape guide 11 and the wire guide 7 arrive at the initial position a almost simultaneously.

Then, the wire guide 7 is shifted into the forward pass, and while it moves from the initiating position a of the coil to the position c, the tape guide 11 is not moved. However, the movement of the tape guide 11 is started when the wire guide 7 arrives at the position c, and both the tape guide 11 and the wire guide 7 are moved toward the right end as described above. The operation as described above is repeated for a required number of times, and a coil having a required number of turns can be thereby obtained.

As is apparent from FIG. 7, the velocity of the forward movement of the tape guide 11 is so controlled that it increases in accordance with its movement along the curve II from the tape winding initiating position c to the coil end position d. Likewise, the velocity of the movement of the tape guide 11 is also varied gradually while the tape guide 11 is moved along the curve III from the position e toward the initial position a. The reason why the speed of the tape guide 11 is varied as described above resides in that the widthwise overlapping amount of the insulating tape 22 is thereby successively varied, and the thickness of the inter-layer insulation is thereby varied for withstanding the interlayer voltage created across the two coil layers. It is of course possible that the tape guide 11 be otherwise controlled at a constant speed or at a speed different from the above described value by varying the operational characteristic of the function generator 17 shown in FIG. 6. Furthermore, the invention may otherwise be so constructed that the insulating tape is applied only at a portion between the coil layers, thus providing no coil end insulation.

Figure 8:
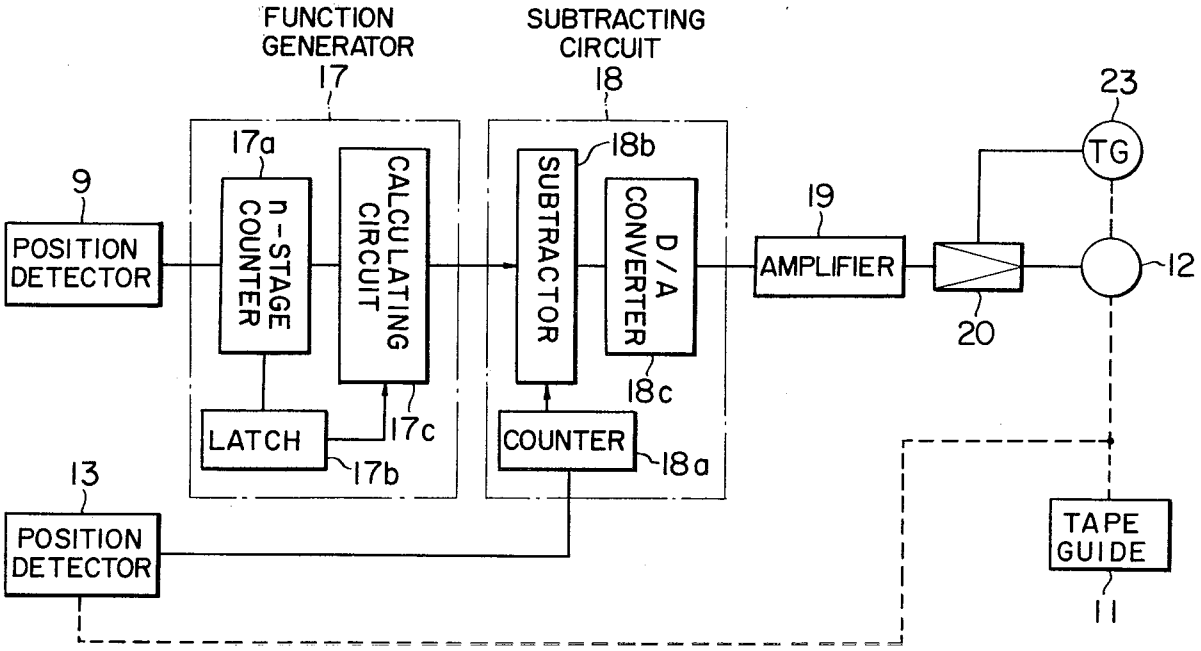
FIG. 8 is a block diagram showing a more detailed example of the servomotor control system shown in FIG. 6.

FIG. 8 shows an example of the servomotor control system of FIG. 6 in more detail, wherein the position detectors 9 and 13 are pulse generators, and the function generator 17 comprises an n-stage counter 17*a* for counting the output pulses from the position detector 9, a latch 17*b* that reverses its output each time it receives a carrying output or a borrowing output from the counter 17*a*, and a calculating circuit 17*c* connected to the outputs of the n-stage counter 17*a* and the latch 17*b* for executing the following calculations.

For the rightward movement of the tape guide:

$X=0$ when $Y \leqq C_1$ $X=K_1Y^2+K_2Y+K_3$ when $Y>C_1$ and for the leftward movement of the tape guide:

$X=X_1$ when $Y \leqq C_1$ $X=X_1-(K_1Y^2+K_2Y+K_3)$ when $Y>C_1$ where X represents a movement of the tape guide 11, Y represents a movement of the wire guide 7, $K_1$, $K_2$, and $K_3$ represent constants, and $X_1$ represents the entire movement of the tape guide 11.

Accordingly, the output signal from the calculator 17*c* corresponds to the curve II or III of FIG. 7 depending on the moving direction of the tape guide 11.

In the circuit of FIG. 8, the subtractor in FIG. 6 is replaced by a subtracting circuit 18 which comprises a counter 18*a* connected to count the output pulses of the position detector 13, a subtractor 18*b* for subtracting the count of the counter 18*a* from the output of the calculating circuit 17*c*, and a D/A converter 18*c* which converts the output of the subtractor 18*b* into an analog value such as a voltage or current. The output of the D/A converter 18*c* is applied through an amplifier 19 to the servoamplifier 20 of the servomotor 12, and therefore the movement of the tape guide 11 is controlled as shown by the curves II and III in FIG. 7 through a closed loop control circuit comprising the servomotor 12, tape guide 11 driven by the servomotor, position detector 13 mechanically coupled with the tape guide 11, and others. It is apparent that the function generator 17 and the related circuits may otherwise be replaced by a microcomputer and I/O devices associated therewith.

According to the present invention, there is provided a coil winding machine including a device for driving a coil winding spindle detachably supporting an insulating bobbin, and devices for supplying an insulating tape and a coil wire onto the bobbin, whereby the interlayer insulation is formed by the insulating tape. Furthermore, since the interlayer insulation is provided simultaneously with the winding operation of the coil wire, automatic control of the coil winding machine can be facilitated, and the time required for the production of the coils can be substantially reduced.

What is claimed is:

1. A coil winding machine for manufacturing a multilayer coil having a number of coil layers and interlayer insulator layers made of an insulating tape, which machine comprises a coil winding spindle detachably supporting an insulating bobbin, a driving device for driving said coil winding spindle, first and second feed screws extending in parallel with said bobbin, said first feed screw being driven by said driving device through a change gear containing a reversible clutch, said second feed screw being driven by a servomotor, a wire guide and tape guide mounted on said first and second feed screws respectively, first and second position detectors for detecting the positions of said wire guide and said tape guide along said first and second feed screws, and a control circuit for controlling operation of said servomotor based on the output of said first and second position detectors, said control circuit comprising a function generator connected to an output of said first position detector, a subtracting circuit connected to deliver a difference signal between outputs of said function generator and said second position detector, and means for supplying the difference signal to said servomotor.

2. A coil winding machine as set forth in claim 1 wherein said function generaor generates, during a forward run of the tape guide along said second feed screw, a first output signal which is equal to zero when the output (Y) of the first position detector is equal to or less than a predetermined value ($C_1$), but is varied in accordance with a function of the output (Y), varying at first slowly and later quickly to an ultimate value ($X_1$) when the output (Y) is larger than the predetermined value ($C_1$), and during a rearward run of the tape guide along said second feed screw, said function generator generates a second output signal which is equal to the ultimate value ($X_1$) when the value of the output (Y) is equal to or less than the predetermined value ($C_1$), but is varied to zero in accordance with a function of the output (Y) similar to that in the forward run of the tape guide when the value of the output (Y) is larger than the predetermined value ($C_1$).

3. A coil winding machine as set forth in claim 2 wherein said first and second position detectors are pulse generators, and said function generator comprises an n-stage counter where n is an integer larger than one, for counting the output pulses of said first position detector, a latch circuit which inverts the output of the counter depending on whether the latch circuit receives a carry output or a barrow output from said counter, and a calculating circuit connected to receive outputs of the counter and said latch circuit for delivering said first and second output signals.

4. A coil winding machine as set forth in claim 3 wherein said subtracting circuit comprises a counter connected to count the number of output pulses of said second position detector, a subtractor for subtracting a count of said counter from an output of said calculating circuit, and a D/A converter for converting an output of said subtractor into an analog value adapted to control said servomotor in a direction to reduce the output of said subtractor.

* * * * *